US006590171B1

(12) United States Patent
Wolf et al.

(10) Patent No.: US 6,590,171 B1
(45) Date of Patent: Jul. 8, 2003

(54) HAND CONTROL FOR MACHINERY

(75) Inventors: Richard J. Wolf, Andover, MN (US); Alex Ginzburg, Mendota Heights, MN (US); Peter Chatman Leuty, Saint Louis Park, MN (US); Stephen Richard Reichow, Eden Prairie, MN (US); Ronald Clarence Celander, Loretto, MN (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/188,501

(22) Filed: Jul. 2, 2002

(51) Int. Cl.[7] ..... H01R 13/70
(52) U.S. Cl. ..... 200/51 LM; 200/6 A
(58) Field of Search ..... 200/556, 6 A, 200/4, 18, 293.1, 51 LM, 318; 73/483; 74/471 XY; 345/27

(56) References Cited

U.S. PATENT DOCUMENTS

| | | | | | |
|---|---|---|---|---|---|
| 3,401,240 | A | | 9/1968 | Groves | 200/6 |
| 3,651,391 | A | | 3/1972 | Vogelsberg | 318/446 |
| 3,679,846 | A | | 7/1972 | Dillon et al. | 200/6 |
| 3,708,636 | A | * | 1/1973 | Sobchak | 200/6 A |
| 3,811,018 | A | * | 5/1974 | Kaplan | 200/6 A |
| 3,818,154 | A | | 6/1974 | Presentey | 200/6 |
| 3,827,313 | A | | 8/1974 | Kiessling | 74/471 |
| 3,898,397 | A | * | 8/1975 | Devore et al. | 200/6 A |
| 4,125,783 | A | | 11/1978 | Sefton | 307/116 |
| 4,132,902 | A | | 1/1979 | Everest | 307/116 |
| 4,156,575 | A | | 5/1979 | Konig et al. | 404/84 |
| 4,230,916 | A | | 10/1980 | Mochizuki | 200/6 |
| 4,237,629 | A | * | 12/1980 | Schmidt | 37/234 |
| 4,273,972 | A | | 6/1981 | Butterworth | 200/6 |
| 4,308,434 | A | | 12/1981 | Roeser | 200/6 |
| 4,493,377 | A | | 1/1985 | Gunther et al. | 173/170 |
| 4,794,273 | A | | 12/1988 | McCullough et al. | 307/139 |
| 5,212,621 | A | | 5/1993 | Panter | 361/181 |
| 5,233,231 | A | | 8/1993 | Wieth et al. | 307/116 |
| 5,235,217 | A | | 8/1993 | Kirton | 307/326 |
| 5,341,036 | A | | 8/1994 | Wheeler et al. | 307/328 |
| 5,583,386 | A | | 12/1996 | Meixner et al. | 307/326 |
| 5,831,554 | A | * | 11/1998 | Hedayat et al. | 341/20 |
| 5,856,646 | A | | 1/1999 | Simon | 200/600 |
| 6,106,398 | A | | 8/2000 | Davis | 463/38 |
| 6,148,094 | A | | 11/2000 | Kinsella | 382/124 |

* cited by examiner

*Primary Examiner*—Elvin Enad
*Assistant Examiner*—Lisa N Klaus
(74) *Attorney, Agent, or Firm*—Roger C. Turner

(57) ABSTRACT

A machine control (10) for controlling machinery, is disabled unless the hand (H) of a person grasps a handgrip (14) of the control, and thereby increases the capacitance at each of two electrodes (52, 54) lying within the handgrip surface and spaced about the handgrip axis (56). The handgrip is formed on a handle of a joystick (20) that can pivot about two perpendicular horizontal axes (22, 24). The joystick has a lower end (122) that lies in a cavity (120) where the joystick is pivotally mounted, the joystick has an upper end (121) forming a handle, and the joystick has a middle portion (124) that projects through an upper end of the cavity that lies within an aperture (114) of a housing top wall (112). A plurality of joystick detents (141–144) are mounted on the joystick middle portion, and a plurality of housing detents (151–154) are mounted on the housing to each engage a joystick detent. The joystick detents are formed on a collar (170) that is biased downwardly by a coil spring (180), to provide high resilience in deflection of the joystick detent when it engages and disengages a housing detent.

14 Claims, 2 Drawing Sheets

FIG. 1
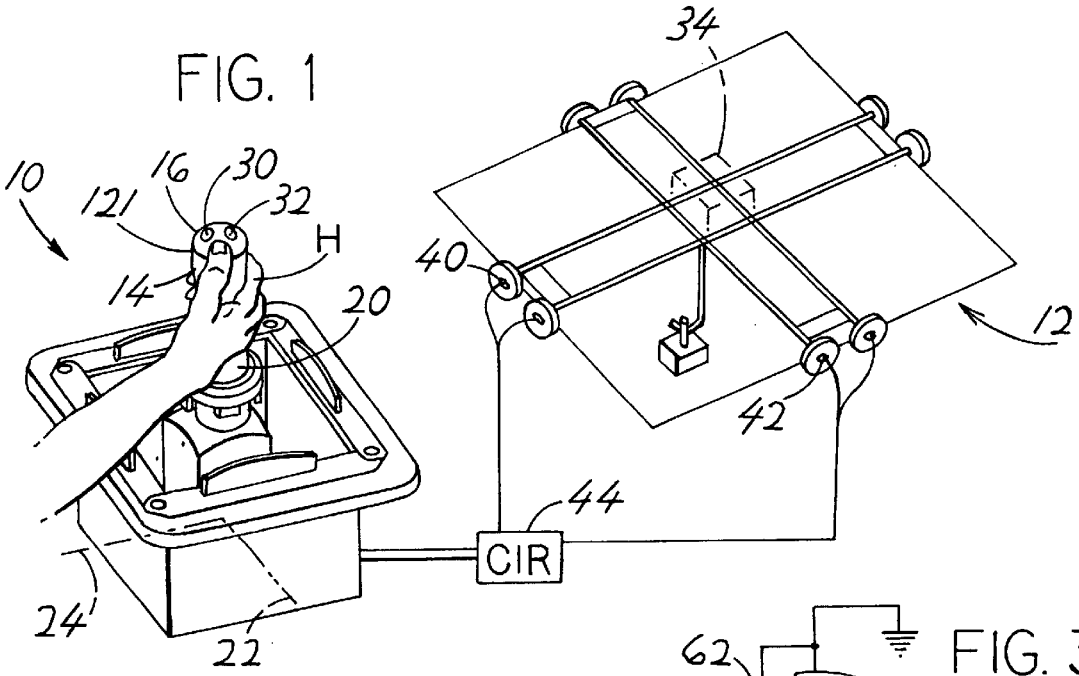
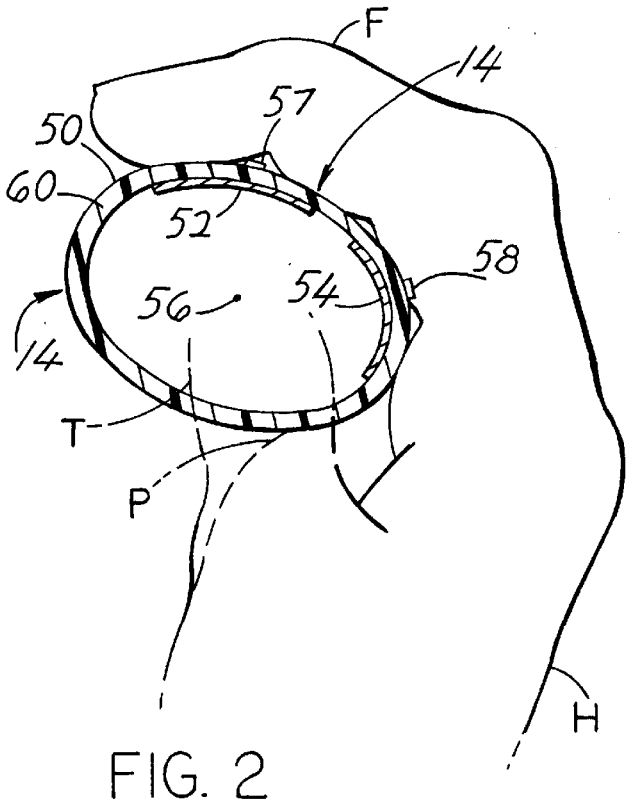
FIG. 2
FIG. 3
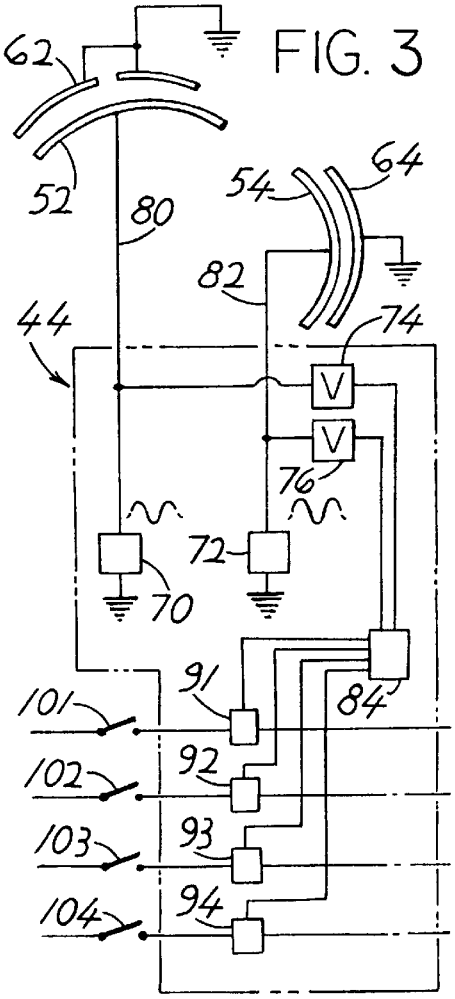

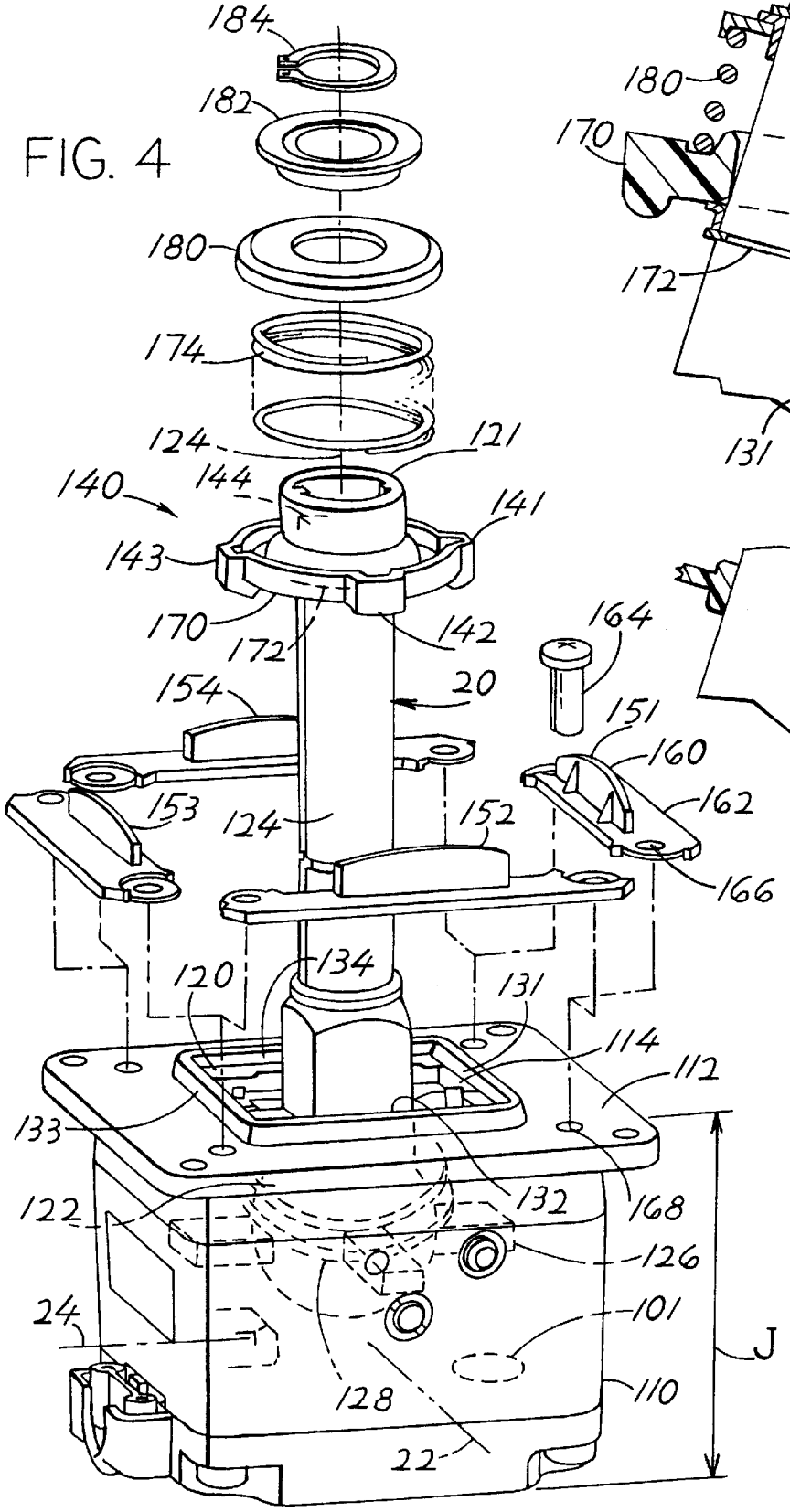
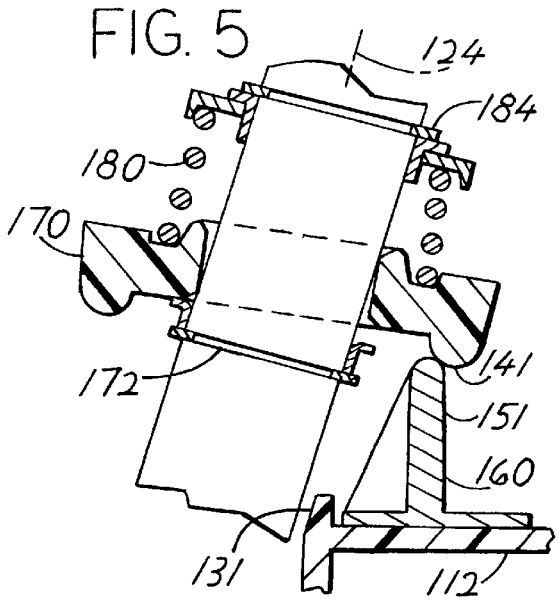
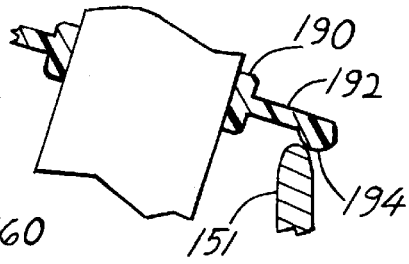
FIG. 6

HAND CONTROL FOR MACHINERY

BACKGROUND OF THE INVENTION

One type of hand operated machine control requires the operator to grasp a handgrip, which may lie at the top of a joystick, and/or operate control buttons on the handgrip. To prevent accidental operation, as when an object leans against the handgrip, a safety switch is commonly provided that must be continually depressed by the operator to enable operation of the equipment. The operator's hand becomes fatigued when he has to continually keep a switch depressed. Also, if the machinery will operate when a single safety switch is depressed, then there is a danger that if an object leans against the safety switch that the machine will inadvertently operate. Instead of a mechanical switch that must be depressed, it is possible to provide an electrode at or under the surface of the handle, which senses the presence of an operator's hand to enable the switch to operate. However, even in that case, an object that leans against the switch, may be sensed as a hand, and enable inadvertent operation of the machinery. A circuit that more reliably sensed the presence of an operator's hand to enable operation of a machine control, would be of value.

A joystick is commonly biased towards a center, or neutral position, although it can be moved in any one of four directions to control a machine. In many cases, the operator must pivot the joystick in one direction and hold it there for an extended period of time. This can be tiring for the operator. Although detents can be located in a cavity where the lower end of the joystick is pivotally mounted, it is crowded in that area, and it is difficult to retrofit detents or repair damaged detents there. A detent system that was readily accessible for retrofit or replacement of damaged parts, and which provided effective biasing of rugged detents, would be value.

SUMMARY OF THE INVENTION

In accordance with one embodiment of the present invention, applicant provides a hand operated machine control which is safe and which avoids tiring of the operator. To assure that an operator's hand is present, a handgrip of the machine control has two electrodes spaced about the handgrip axis, so that the hand of an operator will normally lie adjacent to both of the electrodes simultaneously during operation. The electrodes can lie below the surface that is grasped by the hand, and a circuit connected to the electrodes senses change in capacitance at the electrodes.

Where the handgrip lies at the top of a joystick, fatigue of the operator is further reduced when the joystick must be continuously held at one pivoted position, by provided detents on the joystick and on the housing. A plurality of housing detents are mounted about the aperture through which a middle portion of the joystick projects, and a plurality of joystick detents are mounted on the joystick. The housing detents are mounted on a top wall of the housing, where they are readily accessible for retrofit and for replacement.

The joystick detents are mounted on a collar that is spring biased downwardly but that can tilt and ride up. When a joystick detent rides over a housing detent, the collar is deflected against the biasing of a coil spring that surrounds the joystick, to provide reliable biasing without requiring a weakened resilient portion of the joystick detents.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view showing a machine control of one embodiment of the present invention, and an example of a machine that can be controlled.

FIG. 2 is a sectional view of the handgrip of the machine control of FIG. 1.

FIG. 3 is a schematic diagram of the hand-sensing circuit of the machine control of FIG. 1.

FIG. 4 is an exploded isometric view of the machine control of FIG. 1.

FIG. 5 is a partial sectional view of the machine control of FIG. 4, with the joystick being pivoted to one extreme position.

FIG. 6 is a partial sectional view of a detent apparatus of another embodiment of the invention.

DESCRIPTION OF THE PREFERRED EMBODIMENTS

FIG. 1 illustrates a machine control 10 for operating a machine 12. The machine control includes a handgrip 14 on a handle 16 at the top of a joystick 20. The handle can be grasped by a person's hand H. The person then can operate the control as by moving the top of the joystick in any one of four directions, as the bottom of the joystick pivots about one of two horizontal perpendicular pivot axes 22, 24. In FIG. 1, the handle includes buttons 30, 32 that enable additional control. The particular machine 12 that is illustrated, has a winch 34 that can be moved in four directions by actuation of motors 40, 42. The motors are energized by a circuit 44 that is controlled by the machine control 10, but only if the machine control senses that a person's hand is operating it.

FIG. 2 illustrates the handgrip 14 which has an outer surface 50 that can be grasped by a person's hand H. In FIG. 2, a finger F and a portion of the palm P of the hand are shown partially encircling the grip, while the thumb T extends upward to the top of the handle to operate push buttons.

The handgrip includes first and second electrodes 52, 54 that are spaced about the grip axis 56. The grip includes an insulative shell portion 60, and the electrodes 52, 54 lie on the inside of the shell so they are spaced inwardly from the outer grip surface 50. The electrodes are positioned so during normal gripping of the handgrip, portions of the person's hand will lie adjacent to both electrodes 52, 54. The person's body acts as a ground of largely constant potential, and the hand and other portions of the body have moderately low resistance. As a result, when a portion of the hand lies close to the electrodes 52, 54, a capacitance is established between each electrode and the hand.

FIG. 3 shows the electrodes 52, 54 and adjacent portions of the hand that are drawn as though they were grounded electrodes 62, 64. As a result of each corresponding pair of electrodes such as 52, 62 lying close together along a large area, there is a significant capacitance between the electrode 52 and a hand portion 62, and between electrode 54 and hand portion 64. The sudden increase in capacitance can be detected by the circuit 44. In a simplified example, the circuit includes two alternating current sources 70, 72 which are respectively connected to the electrodes 52, 54. A pair of voltage detecting subcircuits 74, 76 detect the root mean square of the voltage at the electrodes 52, 54. If there is a very low capacitance, resulting from no hand being present, the voltage at 52 and 54 will vary considerably, resulting in a large root mean square voltage on each line 80, 82. However, when a person's hand provides electrodes at 62, 64 that are substantially grounded, this results in a high capacitance, so the root mean square of voltage on lines 80 and 82 is much lower.

In another circuit, a charge transfer sensing integrated circuit (IC) is provided for each electrode. The IC emits a sense field onto the electrode to charge the stray capacitance. The charge transfer IC then transfers this charge into a sampling capacitor, filters it and measures the voltage level. From this voltage level, the charge transfer IC determines presence or touch, and sets its output accordingly. The output from the charge transfer IC is fed through a low pass filter that filters out any short pulses and noise, and into a driver circuit. The driver circuit performs voltage level shifting, short circuit and over temperature monitoring. The output of the driver circuit is fed to the equipment controller for processing.

In FIG. 3, the outputs of the two voltage detecting circuits 74, 76 drive a subcircuit 84 that opens gates 91–94 when no hand is detected. When closed, the gates 91–94 allow current to flow from any one of four switches 101–104 that are each closed when the joystick moves in one of four directions from its neutral or center position. Of course there may be a different number of switches than four.

It would be possible to provide electrodes on the outer surface 50 of the handgrip shown in FIG. 2, and to measure a resistance change between electrodes when the handgrip is gripped by a hand. However, applicant prefers to measure capacitance change at two locations. It is noted that each electrode 52, 54 preferably extends by more than 10° about the axis 56, to provide a wide area so that it is likely to detect a hand at each of the wide areas. At least two locations on the two electrodes are preferably spaced apart by at least 90°. Locations 57, 58 on the grip outer surface that lie directly outside each electrode can be marked to indicate to the person the two locations to touch.

FIG. 4 shows that the machine control 10 includes a housing 110 with an upper or top wall 112 that forms an aperture 114. A cavity 120 that lies within the housing, is open at its top through the aperture 114 in the top wall. The joystick 20 has an upper portion 121 which holds the handle 16 (FIG. 1), and a middle portion 124 that extends through and above the aperture to the upper portion 121. The joystick has a lower portion 122 that lies within the cavity. The joystick is shown raised about an inch or two above its fully installed position. When the joystick is lowered an inch or two for full installation, the joystick lower portion is pivotally mounted about the two axes 22, 24 and arms 126 can close switches such as 101. Patent application Ser. No. 09/870,211 filed May 28, 2001 describes a joystick pivotally mounted about two horizontal axes and a switch arrangement for closing any switches as the joystick is pivoted in any of the four directions. A spring 128 urges the joystick towards it neutral position wherein its axis 124 is vertical.

In many operations, it is necessary for the operator to hold the joystick pivoted against one of the four walls 131–134 of the aperture for an extended period of time. If the operator's hand must keep the joystick in a pivoted position, against the force of the spring that urges it back towards the vertical, then this can tire the operator's hand. In accordance with another aspect of the invention, applicant provides a detent arrangement 140 that holds the joystick substantially against a selected one of.the four aperture sides 131–134, without requiring the operator to continuously overcome the force of the spring that urges the joystick towards the vertical. The detent arrangement includes four joystick detents 141–144 and four corresponding housing detents 151–154 each lying at about the height of the upper wall(within an inch below and two inches above, for a housing having a height J of four inches).

The housing detents each includes an upstanding rib 160 and a mounting plate 162. The mounting plate mounts on the top wall 112, as with screw fasteners 164 that pass through corresponding holes 166 in the mount plate and that screw into threaded holes 168 in or below the housing top wall. The ribs 160 project above the top wall 112. The four joystick detents 141–144 are formed on a collar 170. The collar 170 is limited in downward movement by a retaining ring 172, and is biased downwardly by a detent coil spring 174 that extends about the joystick. A pair of washers 180, 182 and an upper retaining ring 184 hold down the upper end of the coil spring.

When the joystick is pivoted to one side, as shown in FIG. 5, a joystick detent 141 passes across the top of a housing detent 151 at its rib 160. The downward force of the spring 180 results in the joystick detent 141 reliably holding the joystick in its tilted position. The coil spring also assures that the joystick will pivot back to its neutral position when a predetermined sideward force is applied to the joystick. The collar 170 is rugged because it does not have to deflect, and the coil spring 180 is a reliable element. It is possible to precompress the springs 128, 174 so that it takes a considerable force (e.g. 2 pounds) to tilt the joystick to an aperture side 131, and only a small force (one ounce) to keep it there, but with the joystick automatically returning to neutral if the maintaining force (one ounce) is not applied.

FIG. 6 shows another arrangement, wherein a collar 190 has bendable arms 192 with detent ends 194 that engage the housing detent 151. Although such an arrangement will operate, the reduction in robustness of the collar due to the thinned arm 192 for deflection, reduces the reliability.

Instead of having a collar 170 of FIG. 4 that can tilt and slide along the axis 124 of the joystick, it is possible to use a collar that does not tilt, but only slides along the axis.

While terms such as "upper", "bottom", etc. have been used to describe the hand control as it is illustrated, the hand control can be used in positions tilted from those shown.

Thus, the invention provides a machine control with a handgrip that is gripped by a person's hand and with a plurality of switches that can operated as the person grasps the handgrip. At least two electrodes lie near two locations of the outer grip surface at locations spaced about the handgrip axis, and a circuit senses the presence of a hand at both locations to enable the control to control a machine. The handgrip can be formed at the upper portion of a joystick. A detent arrangement that enables retrofit mounting and easy removal for replacement of damage parts, includes a plurality of housing detents mounted about the aperture in the housing, on the upper wall of the housing and preferably project above the upper wall. Joystick detents are mounted on a joystick middle portion that projects through the aperture at the tope of the housing cavity. The joystick detents can be formed on a collar that can move on the joystick, and that is biased towards a neutral position by a coil detent spring that surrounds the joystick.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A housing having an upper wall with an aperture therein, said housing forming a cavity that lies below said upper wall and that is open through said aperture;

a joystick which has a middle portion that extends through said aperture, a lower end lying in said cavity and pivotable about two perpendicular horizontal axes, and an upper end lying above said middle portion and forming a handle;

a plurality of joystick detents mounted on said joystick middle portion;

a plurality of housing detents mounted on said housing and lying at about the height of said upper wall and in the paths of said joystick detents, so each joystick detent engages a housing detent when the joystick middle portion is moved thereto.

2. The machine control described in claim 1 wherein:

said plurality of joystick detents includes a collar moveably mounted on said joystick, and a coil spring mounted on said joystick and biasing said collar toward a predetermined position and orientation on said joystick.

3. The machine control described in claim 1 wherein:

said plurality of housing detents each comprises an upstanding rib that is mounted on said housing upper wall and that projects above the housing upper wall.

4. The machine control described in claim 1 wherein said joystick has a handle forms a handgrip with a handgrip axis, said handgrip having has an outer surface, and including:

a pair of electrodes mounted on said handle and spaced about said axis;

a circuit coupled to said pair of electrodes which enables said machine control to control a machine only if said circuit senses the presence of a person's hand at both of said electrodes.

5. A machine control comprising:

a housing having housing walls forming a cavity, said housing walls including a top wall with aperture walls forming an aperture that leads downwardly into the cavity;

a joystick that has a lower end lying in said cavity and pivotally coupled to said housing to pivot about two perpendicular horizontal axes thereat, said joystick having a middle portion that projects through said aperture, and said joystick having an upper portion forming a handle, said joystick being pivotable from a neutral position wherein said middle portion is spaced from said aperture walls to a plurality of pivoted position wherein said middle portion lies substantially against a location on said aperture walls;

a plurality of joystick detents mounted on said joystick middle portion;

a plurality of housing detents coupled to said housing top wall, each housing detent positioned to engage one of said joystick detents when the joystick is pivoted to a position against one of said aperture walls, to resist pivoting of said joystick toward said neutral position.

6. The machine control described in claim 5 wherein said joystick has a primarily vertical axis, and including:

a collar that is axially slideable about said joystick, and a spring that biases said collar downward, said joystick detents lying on said collar to move with said collar.

7. The machine control described in claim 5 wherein:

said handle has a grip surface that can be grasped by the hand of a person, said grip surface having a grip axis;

a pair of electrodes mounted on said handle and spaced about said grip axis;

circuit means connected to said electrodes for enabling effective operation of said machine control only when a portion of the person's hand is detected at both of said electrodes.

8. The machine control described in claim 5 wherein:

said housing top wall has a plurality of vertical holes;

said housing detents each lies on said housing top wall and includes a plurality of fasteners that each extends into one of said holes and that fastens one of said housing detents to said top wall.

9. The machine control described in claim 8 wherein:

each of said housing detents includes a horizontal mount base and an upstanding rib that projects upward from the base.

10. A machine control which includes a handgrip control that has an axis and that can be grasped and operated to energize motors that control a machine, comprising:

a pair of electrodes mounted at circumferentially spaced locations about said handgrip;

circuit means for detecting the presence of a person's hand at both of said circumferentially spaced locations, for enabling energization of said motors upon operation of said handgrip control only when the presence of a person's hand is detected at both of said locations.

11. The machine control described in claim 10 wherein:

said handgrip control includes a housing with a top wall that has an aperture, said housing having walls forming a cavity lying under said top wall and accessible through said aperture, and a joystick with a lower end pivotally mounted on said housing in said aperture, an upper end forming said handgrip control, and a middle portion lying between said lower and upper portion, and including a plurality of joystick detents mounted on said joystick middle portion;

a plurality of housing detents mounted about said aperture at said top wall.

12. A machine control for controlling a machine, comprising:

a housing:

a handgrip mounted on said housing and constructed to control said machine, said handgrip having an outer grip surface that can be grasped by a hand;

a circuit coupled to said handgrip for assuring that the handgrip is being gripped by sensing change in capacitance, said circuit including at least two electrodes lying adjacent to said outer grip surface, said electrodes lying within and spaced from said outer grip surface, and said circuit being constructed to prevent operation of said handgrip from controlling the machine unless a capacitance is detected simultaneously at both of said electrodes that indicate grasping by a person.

13. The machine control described in claim 12 wherein:

said circuit connects said electrodes in parallel and prevents operation of the machine unless an increase in capacitance is detected at each of said electrodes.

14. The machine control described in claim 12 wherein:

said housing has an upper wall with an aperture and said housing forms a cavity below said aperture;

said machine control includes a joystick with an upper end having a handle that forms said handgrip, said joystick having a lower end that lies in said cavity and that is pivotable about two perpendicular axes on said housing; and including:

a plurality of joystick detents mounted on said joystick vertically between said joystick handle and said joystick lower end;

a plurality of housing detents mounted on said housing and lying at about the height of upper wall;

said joystick detents being moveable in a plurality of directions toward aperture walls of said top wall, and against corresponding ones of said housing detents so the corresponding joystick and housing detents engage to help hold the joystick in a pivoted position to which the joystick has been pivoted.

* * * * *